US006037574A

United States Patent [19]

Lanham et al.

[11] Patent Number: 6,037,574

[45] **Date of Patent: *Mar. 14, 2000**

[54] QUARTZ SUBSTRATE HEATER

[75] Inventors: Christopher C. Lanham, O'Fallon; Kevin Ptasienski, Maryland Heights; Louis P. Steinhauser, St. Louis; Robin H. Lake, Ballwin, all of Mo.; James H. Kreisel, Winona, Minn.

[73] Assignee: Watlow Electric Manufacturing, St. Louis, Mo.

[ * ] Notice: This patent issued on a continued prosecution application filed under 37 CFR 1.53(d), and is subject to the twenty year patent term provisions of 35 U.S.C. 154(a)(2).

[21] Appl. No.: 08/964,385

[22] Filed: Nov. 6, 1997

[51] Int. Cl.[7] ..... H05B 3/44

[52] U.S. Cl. ..... 219/544; 219/390; 219/541; 219/543

[58] Field of Search ..... 219/544, 457, 219/458, 459, 462, 464, 543, 390; 338/307, 308, 309; 392/407, 432, 433, 438, 439, 418

[56] References Cited

U.S. PATENT DOCUMENTS

| | | | |
|---|---|---|---|
| 3,047,702 | 7/1962 | Lefebvre | 219/19 |
| 3,541,305 | 11/1970 | Kuwayama et al. | 219/467.1 |
| 3,978,316 | 8/1976 | Rose et al. | 219/543 |
| 4,357,526 | 11/1982 | Yamamoto et al. | 219/543 |
| 4,531,047 | 7/1985 | Canfield et al. | 219/354 |
| 4,733,056 | 3/1988 | Kojima et al. | 219/543 |
| 4,785,150 | 11/1988 | Kojima et al. | 219/543 |
| 4,806,739 | 2/1989 | Kojima et al. | 219/543 |
| 5,343,021 | 8/1994 | Sato et al. | 219/541 |
| 5,409,668 | 4/1995 | Bagley et al. | 219/543 |
| 5,498,855 | 3/1996 | Deevi et al. | 219/553 |
| 5,693,244 | 12/1997 | Pragt et al. | 219/441 |
| 5,753,893 | 5/1998 | Noda et al. | 219/548 |
| 5,911,896 | 6/1999 | Holden et al. | 219/390 |

FOREIGN PATENT DOCUMENTS

| | | |
|---|---|---|
| 09148056 | 11/1995 | Japan . |
| 08138845 | 5/1996 | Japan . |

*Primary Examiner*—Teresa Walberg
*Assistant Examiner*—Vinod D Patel
*Attorney, Agent, or Firm*—Herzog, Crebs & McGhee, LLP

[57] ABSTRACT

An electric, resistance element heater utilizes quartz as a sheath material and has a resistance (heating) element that is in intimate, substantially continuous contact with a surface of the quartz. This allows the heater to operate in any one or all of the three modes of heat transfer, namely, radiation, conduction and convection. Such intimate, substantially continuous contact of the resistance element is achieved by applying the element in direct contact with the quartz surface. This is accomplished by applying a heating circuit directly to the quartz surface, which heating element can be a foil element, or a thick or a thin film deposition element. The overall heater is formed by covering the heater element by a quartz sheath and attaching leads formed on the ends of the heater element to a source of electric energy. Sensors such as thermocouples, RTD's and the like can also be incorporated directly into the heater structure. Also, the heater can be fashioned into a variety of shapes.

37 Claims, 3 Drawing Sheets

QUARTZ SUBSTRATE HEATER

FIELD OF THE INVENTION

The present invention relates to electric heaters and, more particularly, to electric resistance heaters utilizing one or more quartz substrates.

BACKGROUND OF THE INVENTION

It is known that there are three types or modes of heat transfer, namely conduction, convection, and radiation. All electric resistance heaters utilize one of those forms of heat transfer in order to supply heat to the surrounding environment. In general, electric resistance heaters have a heat generating element (e.g. a resistance wire) that is coupled to a source of electrical energy. When the electrical energy is supplied to the resistance wire, the wire will heat up due to its resistance. The amount of heat produced by the resistance wire is a factor of the wire material and shape, and the voltage, current and/or frequency of the electrical energy supplied thereto.

Generally, in electric resistance heaters, the resistance wire is surrounded by and/or minimally in contact with a sheath material. The sheath material also contributes to the operating characteristics of the heater.

It is also known to have electric heaters that utilize quartz for the outer sheath material even though quartz is considerably more expensive to use as compared to more common heater sheath materials such as metals or ceramics. There are many reasons for utilizing quartz, including:

1. Quartz can endure high temperature use.
2. Quartz is relatively transparent to infrared energy which allows the heat generating element inside the quartz to radiate heat directly from the element to the process or load with little elevation in temperature of the quartz.
3. Quartz is considered to be one of the few acceptable materials for use in specialty environments or processes such as ultra pure semiconductor processing, e.g. heating deionized water.
4. Quartz has a low thermal coefficient of expansion which inherently gives it the ability to withstand significant thermal shock and temperature excursions without fracturing.
5. Quartz has reasonably good resistance to corrosion when exposed to many chemicals and deionized water.
6. Quartz is typically a fused glass material with a very small molecular spacing. It is thus possible to fabricate sealed heaters that do not "breath" or allow contaminants around them to penetrate therethrough and attack the heating element, nor allow materials liberated by the heating element from contaminating the process or surrounding environment.

However, while there are known electric resistance heaters that utilize quartz as the outer sheath material, the configuration of such prior art heaters generally dictate that they function as radiant heaters (in the radiant mode of heat transfer) and not as convective or conductive heaters (respectively the convective mode of heat transfer and the conductive mode of heat transfer). This situation exists because the prior art quartz heaters do not substantially heat the quartz itself as is needed for convection and conduction type heating to occur. As such, the prior art electric resistance quartz heaters do not take advantage of the many characteristics of quartz as a sheath material and thus do not operate as convection or conduction mode heaters. This limits the scope of applications in which the heater may be used.

In U.S. Pat. No. 3,047,702 entitled Plate Heater, issued to F. L. Lefebvre on Jul. 31, 1962, there is disclosed a plate heater that utilizes quartz. A resistance element formed as a coil is retained against a surface of a quartz plate such that portions of the coil are in contact therewith. However, because most of the heating surface of the helixes of the resistive coil is not in contact with the quartz, there is little heating of the quartz. Rather than transferring heat to the quartz plate, the heating coil heats up the surrounding medium. Thus the '702 plate heater generally only operates in a radiant heat transfer mode making the heater rather inefficient and/or limiting its use to lower temperature heating applications.

In U.S. Pat. No. 4,531,047 entitled Clip-Mounted Quartz Tube Electric Heater, issued to Canfield et al. on Jul. 23, 1985, there is disclosed an electric heater which includes a quartz tube having a heater coil therein. The heater coil is supported by a ceramic support that extends the length of coil and is formed with a heat reflecting groove. Small arcuate portions of each helix of the heater coil are in contact with the inner surface of the quartz tube. The '047 patent recognized that prior art quartz heaters such as the Lefebvre '702 patent were deficient as indicated above and thus tries to alleviate the deficiencies by adding a supporting heat reflecting member to concentrate the heat developed within the tube by the heating coil.

In view of the above, it is an object of the present invention to provide a more efficient quartz heater.

It is another object of the present invention to provide a quartz heater that can operate in any one or all three of the three heat transfer modes.

It is yet another object of the present invention to provide an electric, resistance element type heater having a quartz sheath in which the quartz sheath supplies heat in the convection or conduction heat transfer mode.

SUMMARY OF THE INVENTION

The present invention is an electrical resistance heater having a quartz substrate/sheath that allows the heater to be used in any one or all of the three heat transfer modes; radiant, convection, and conduction.

The above is accomplished in the present invention by having the electric heating element(s) in continuous, intimate contact with the quartz substrate/sheath. Preferably, the electric heating element is applied directly to the substrate/sheath and covered by another quartz substrate/sheath. This forms a laminate structure.

In one form thereof, the heater comprises a laminate structure having a first quartz substrate onto which is directly disposed an electric heating element, and a second quartz substrate covering the exposed heating element. This approach allows use of the heater in the conduction and convection modes of heat transfer, which depends on intimate contact between the electric heating element and the quartz. This results in a lower element temperature enabling higher power densities. Being thus heated, the outer quartz surfaces provide heat to the process and/or load in both the convective and conductive heat transfer modes.

In one form thereof, the laminate structure is formed of a first quartz substrate, cut to the desired shape, onto which is disposed an etched foil electric heating circuit of a given pattern, and a second, complementary quartz substrate placed over the heating element. The electric heating element is laminated/sandwiched between the two quartz substrates, with the two quartz substrates permanently attached to each other to hold the laminate structure together by a welding process, a specially formulated sealing glass such as that made by Vitta Glass Co., or other process. The fusing of the two quartz substrates may be either continuous or discontinuous depending on whether or not the finished heater needs to be sealed from the environment in which it will be used.

In another form thereof, the laminate structure is formed of a first quartz substrate, cut to the desired shape, onto which is screen printed a conductive or resistive ink, thereby forming the heater element. The printed circuit is accomplished by utilizing specialty conductive inks manufactured by companies such as Electro Science Laboratories. The screen-printed ink (electric heater circuits) is then cured through a firing/sintering process. After curing, a second quartz substrate is placed over the heater circuit and attached in the same manner as that described above with regard to the etched foil heater element.

In yet another form thereof, the laminate structure is formed by depositing a thin conductive film onto a first quartz substrate using a thin film deposition process such as sputtering, chemical vapor deposition or otherwise. Again, a second quartz substrate is attached over the electric heater circuit and onto the first quartz substrate.

Leads or terminals are provided on the heating element to which external power leads are attachable, either before fusing, if the leads are internal to the laminate structure, or after fusing, if the leads are external to the laminate structure.

In applying the principles of the present invention, it should be readily understood that the quartz substrates may take on any form or shape such as a tube, tank, polygonal, or otherwise. The electrical circuits can be assembled or applied on the inside and/or outside surfaces of the quartz substrates. Dependent on the application and shape, thick film, thin film or foil circuits can be used as the heating element. Other types of heating elements can be used if applied according to the principles of the present invention.

Sensors, such as thermocouples or RTD's can also be included within the heater assemblies. The sensors and their related circuits could be stand-alone, screen-printed, or thin film deposited components or laminations included in the manufacturing process. Also, it is possible to have multiple substrates with circuits applied to multiple surfaces of such substrates.

BRIEF DESCRIPTION OF THE DRAWINGS

The above-mentioned and other features, advantages and objects of this invention, and in the manner in which they are obtained, will become more apparent and will be best understood by reference to the detailed description in conjunction with the accompanying drawings which follow, wherein.

DETAILED DESCRIPTION OF THE INVENTION

Figure 1:
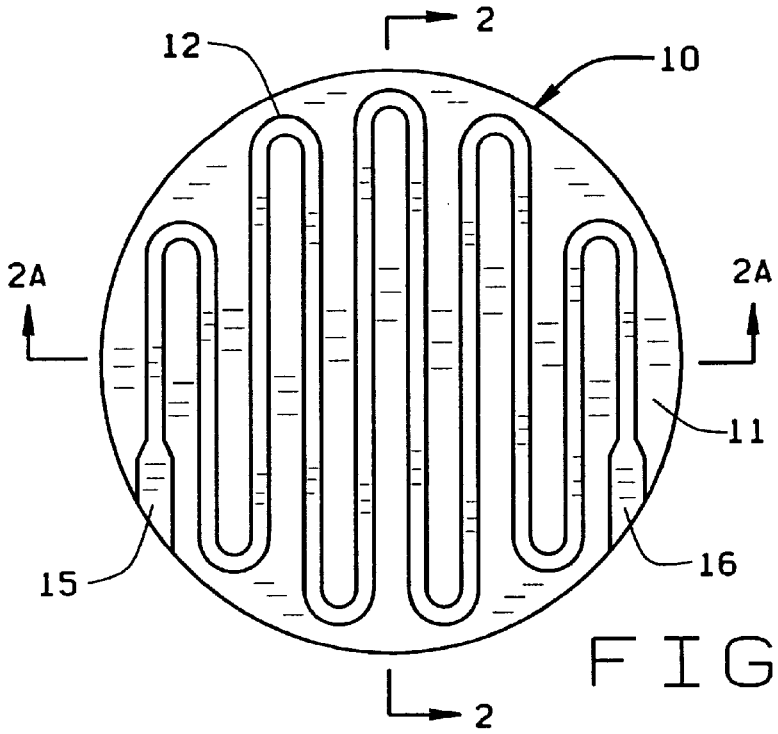
FIG. 1 is a top plan view of a quartz substrate with a heating element thereon in accordance with the principles of the present invention.
Figure 2:
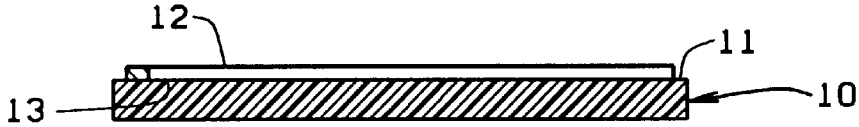
FIG. 2 is a cross-sectional view taken along line 2—2 of FIG. 1.
Figure 2A:
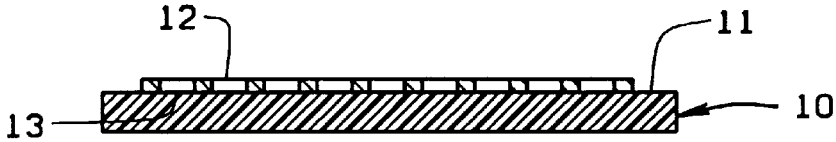
FIG. 2A is a cross-sectional view taken along line 2A—2A of FIG. 1.

Referring now to FIGS. 1 and 2, there is shown a quartz substrate 10, of a generally disk shape. It should be quite clear and understood that the substrate may take substantially any form or shape as can be fashioned from quartz as long as the principles of the present invention as set forth in this specification are followed. Thus, the quartz substrate 10, rather than being disk-shaped, may be tubular (as in FIGS. 6 and 7), spherical, polygonal, or any other shape into which quartz may be fashioned. Further, the substrate 10 shown in FIGS. 1 and 2 is only a portion of the overall heater sheath, but is shown to illustrate the electrical heating element in relation to the substrate.

Disposed directly onto an upper or first surface 11 of the quartz substrate 10 is an electric resistance heating element 12, that, as best seen in FIG. 2, has a lower side or surface 13 that is substantially continuously in direct contact with the upper surface 11 of the quartz substrate 10. By maximizing the contact surface area between the quartz substrate surface and the heating element, the maximum heat transfer is achieved. The shape of the heating element 12 is a matter of design considerations depending on the heater output. In FIG. 1, the heating element 12 is formed in a sinuous pattern upon the quartz substrate upper surface. The heating element 12 terminates at either end in leads or terminations 15, 16, and are adapted to be connected to external electrical leads for the application of electrical energy in a known manner for heating control. The leads (not shown) may be welded, bonded, soldered, brazed, or mechanically attached to the terminations 15, 16, as is well known in the art of electrical heaters.

Maximum, continuous and intimate contact is best accomplished by the use of a flat heating element 12 as shown in the Figures. A flat heating element has very thin side surfaces compared to the upper and lower surfaces thereof and thus, in accordance with the principles defined herein, is an ideal heating element shape, although other shapes, including those with curved surfaces, may be used. The thickness of the flat heating element is exaggerated in the Figures to better demonstrate the configuration thereof.

A flat heating element that has a surface in intimate, and substantially continuous contact with the surface of the quartz substrate is obtainable by several methods. A first method for forming the heating element is to utilize a foil electric heating circuit, such foil electric circuits as are known in the heater industry, that is placed directly onto a surface of a preferably, previously shaped quartz substrate. The foil circuit may be formed by etching, die punching, cutting, or similarly known process.

A second method for forming the heating element is to use a thick film deposition material, such as electrically conductive or resistive inks screen printed directly onto the quartz substrate surface. Such screen printable, conductive and resistive inks that function as heatable resistance elements are obtainable through various companies such as Electro Science Laboratories. Generally with thick film inks, the circuits must be fully cured by a firing/sintering process.

The thick film may also be deposited by banding, printing, or painting, whereby the film is placed on an intermediate substrate and appropriately dried. The film is subsequently transferred to the target quartz substrate and cured to form an electrically conductive thick film circuit.

A third method is to form a thin film heating element by a thin film deposition process such as sputtering, chemical vapor deposition, ion implantation, or other thin film deposition process.

Figure 4:
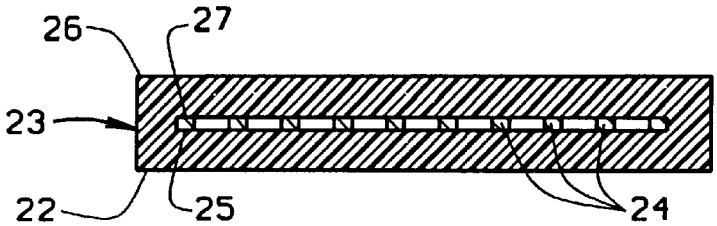
FIG. 4 is a cross-sectional view taken along line 4—4 of FIG. 3.
Figure 3:
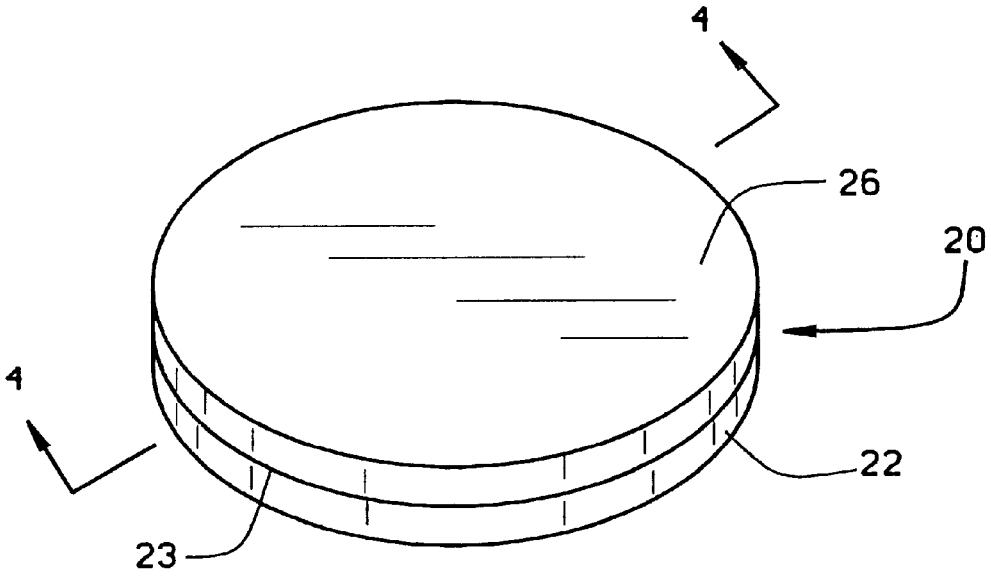
FIG. 3 is a perspective view of a laminated quartz heater structure in accordance with the principles of the present invention.

Another heater structure is depicted in FIGS. 3 and 4, and attention is now directed to those figures. Since the full capabilities of the present heater is optimized by having as much of the surface area of the heating element in direct contact with the quartz substrate, a heater structure 20 preferably consists of a sandwich assembly. A first quartz substrate 22 has a heating element 24 disposed thereon in accordance with the present principles such that a lower surface 25 thereof is in intimate or abutting, substantially continuous contact therewith. A second, preferably complementary in shape quartz substrate 26 is disposed over and onto an upper surface 27 of the heating element 24. The upper surface 27 of the heating element 24 is in intimate or abutting, substantially continuous contact with the surface of the second quartz substrate 26.

The second quartz substrate 26 is clamped onto the first quartz substrate 22 and then preferably permanently attached together at a junction/coupling area 23 either by a welding process or through the use of a specially formulated sealing glass such as those made by Vitta Glass Company thereby forming a heater structure/lamination assembly. The coupling area 23 is represented by a line in FIG. 3 for clarity, however in reality the two substrates 22, 26 become homogenous after the joining, and therefore the coupling area 23 is not visible to the naked eye. The substrates 22, 26 may also be coupled by fusing, bonding, or other similar means. It should, however, be understood that the coupling of the two quartz substrates may be continuous or not depending on whether or not the finished heater needs to be hermetically sealed from the environment in which it will be used. The two substrates may also be pre-loaded to affect a compressive force further improving intimate contact between the substrate and circuit.

Figure 5:
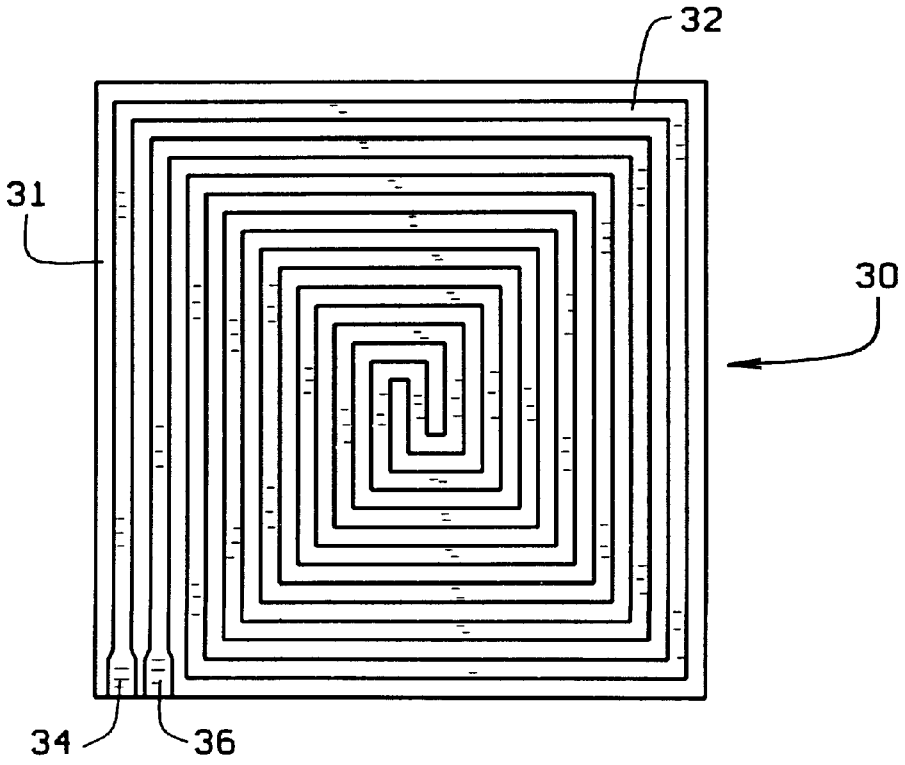
FIG. 5 is a top plan view of an alternative embodiment of a quartz substrate with heating element thereon made in accordance with the principles of the present invention.

FIG. 5 depicts an alternative embodiment of the present invention wherein the quartz substrate 30 is square. The electric heating element 32 is again directly disposed onto a surface 31 of the substrate such that a maximum surface area of one side of the heating element is in substantially continuous, intimate contact with the surface 31. The heating element has terminations 34, 36 again for connection to external electrical leads. Of course, the substrate 30 and heating element 32 is covered by a second quartz substrate in the manner described above in order to complete the heater structure.

Figure 6:
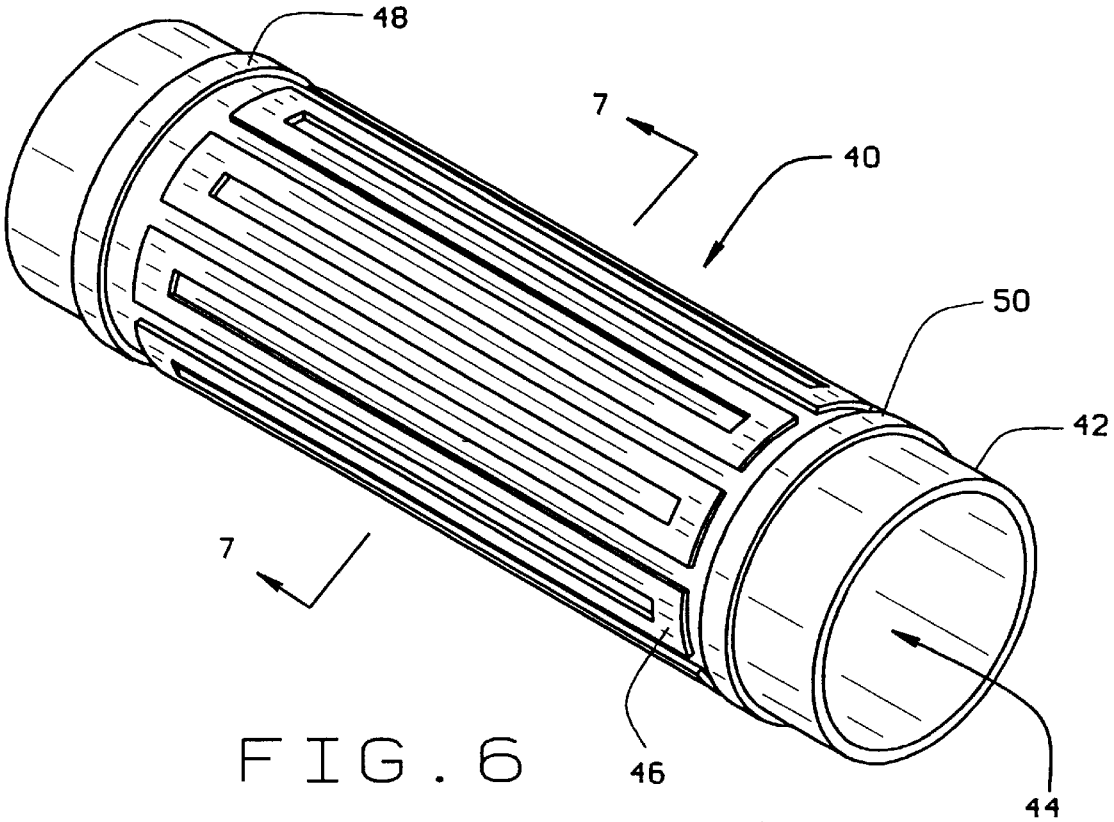
FIG. 6 is an isometric view of the present invention applied to a tubular quartz substrate.
Figure 7:
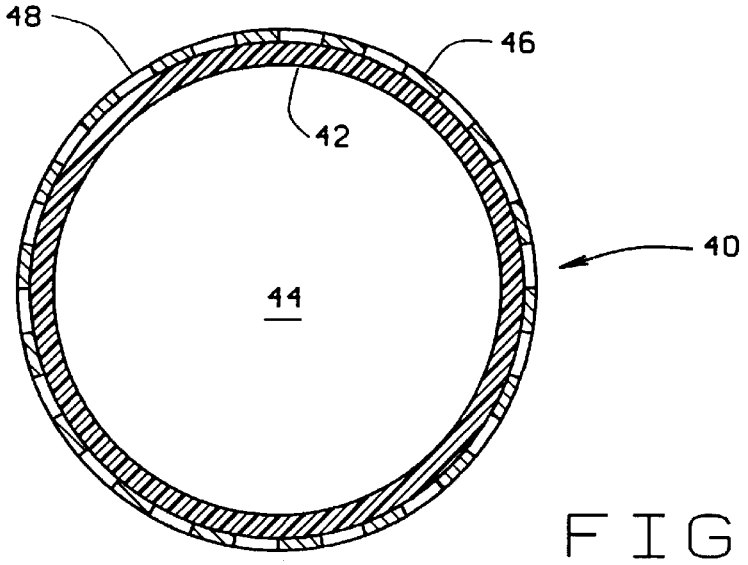
FIG. 7 is a cross-sectional view taken along line 7—7 of FIG. 6.

FIGS. 6 and 7 show another heater 40 incorporating the concepts of the present invention on a quartz tube substrate 42. This embodiment is particularly useful in applications such as heating deionized water, which would flow through the hollow opening 44 of the quartz tube 42. Once again, the heating element 46 is shown with an exaggerated thickness to better demonstrate the configuration thereof. FIG. 6 also shows an alternative configuration for the terminations 48, 50, which here are shaped as bands around the ends of the quartz tube 42, thus alleviating any required orientation of the heater 40 when coupled to a power source.

It should also be understood that the quartz sheath, and thus the respective quartz substrates comprising the quartz sheath, may be manufactured in just about any shape and size with the electrical circuits assembled or applied on the inside and/or outside surfaces thereof. Such would be dependent upon the application of the heater and other design considerations.

Also, it would be possible and within the scope of this disclosure to provide sensors in the heater structures. Such sensors may be thermocouples, RTDs and the like. The sensors and their related circuits could be stand-alone, screen printed, thin film deposited, or the like. Further, several heating elements or circuits may be disposed on single substrates and controlled separately or together.

Accordingly, while this invention is described with reference to a preferred embodiment of the invention, it is not intended to be construed in a limiting sense. It is rather intended to cover any variations, uses or adaptations in the invention utilizing its general principles. Various modifications will be apparent to persons skilled in the art upon reference to this description. It is therefore contemplated that the appended, and any claims will cover any such modifications or embodiments as fall within the true scope of the invention.

What is claimed is:

1. A heater comprising:

a first quartz substrate defining, at least, a first unetched substrate surface;

a heating element defining a first element surface and a second element surface, said first element surface in intimate, substantially continuous contact with said first unetched substrate surface, said heating element having leads adapted to be connected to a source of electrical energy; and a second quartz substrate defining, at least, a second unetched substrate surface, said second unetched substrate surface in intimate, substantially continuous contact with said second element surface.

2. The heater of claim 1, wherein said first quartz substrate is attached to said second quartz substrate.

3. The heater of claim 2, wherein said first quartz substrate is attached to said second quartz substrate by welding.

4. The heater of claim 2, wherein said first quartz substrate is attached to said second quartz substrate by fusing.

5. The heater of claim 4, wherein said first quartz substrate is attached to said second quartz substrate by bonding.

6. The heater of claim 1, wherein said heating element is a thick film deposition element.

7. The heater of claim 1, wherein said heating element is a foil circuit.

8. The heater of claim 1, wherein said heating element is a thin film deposition element.

9. An electric heater comprising:

a quartz substrate having an unetched quartz contact surface area; and a resistance heating element having an element contact surface area and terminations, said resistance heating element disposed onto said unetched quartz contact surface area such that said element contact surface area is in substantially continuous abutting contact with said unetched quartz contact area, said terminations adapted to receive energy form an external power source.

10. The electric heater of claim 9, further comprising:

a second quartz having a second unetched quartz contact surface area; and wherein said resistance heating element has a second element contact surface area, said second element contact surface area being in substantially continuous abutting contact with said second unetched quartz contact area.

11. The electric heater of claim 10, wherein said second quartz substrate is attached to said first quartz substrate by welding.

12. The electric heater of claim 10, wherein said second quartz substrate is attached to said first quartz by fusing.

13. The electric heater of claim 10, wherein said second quartz substrate is attached to said first quartz by bonding.

14. The electric heater of claim 9, wherein said resistance heating element is a thick film deposition element.

15. The electric heater of claim 9, wherein said resistance heating element is a flat conductor.

16. The electric heater of claim 9, wherein said resistance heating element is a foil circuit.

17. The electric heater of claim 9, wherein said resistance heating element is a thin film deposition element.

18. A heater laminate structure comprising:

a first quartz substrate having an unetched contact area;

a second quartz substrate an unetched contact area; and and electric resistance heater element having a first surface area, a second surface area, and a third surface area, said first surface area in substantially continuous abutting contact with said unetched contact area of said first quartz substrate, said second surface area in substantially continuous abutting contact with said unetched contact area of said second quartz substrae; and wherein said first and second heater element surface areas combined are substantially greater than said third heater element surface area.

19. The heater laminate structure of claim 18, wherein said first and second quartz substrates are joined together.

20. The heater laminate structure of claim 19, wherein said second quartz substrate is attached to said first quartz substrate by welding.

21. The heater laminate structure of claim 19, wherein said second quartz substrate is attached to said first quartz substrate by fusing.

22. The heater laminate structure of claim 19, wherein said second quartz substrate is attached to said first quartz substrate by bonding.

23. The heater laminate structure of claim 18, wherein said electric resistance heater element is a thick film deposition circuit.

24. The heater laminate structure of claim 18, wherein said electric resistance heater element is a foil circuit.

25. The heater laminate structure of claim 18, wherein said electric resistance heater element is a thin film deposition circuit.

26. A method of forming a heater comprising:

providing a first quartz having an unetched contact area; and placing an electric heating element directly on said first quartz substrate such that a substantial portion of a first contact area of said electric heating element is in abutting contact with said unetched contact area of said first quartz substrate.

27. The method of claim 26, further comprising the steps of:

providing a second quartz substrate having an unetched contact area; and attaching said second quartz substrate to said first quartz substrate such that a substantial portion of a second contact area of said electric heating element is in abutting contact with said unetched contact area of said second quartz substrate.

28. The method of claim 27, wherein said electric heating element is a thick film deposition circuit.

29. The method of claim 28, wherein said thick film circuit is applied to said quartz substrates by a process from the group consisting of: printing, banding, transferring, and painting.

30. The method of claim 15, wherein said second quartz substrate is attached to said first quartz substrate by welding.

31. The method of claim 27, wherein said electric heating element is a foil circuit.

32. The method of claim 31, wherein said foil circuit is formed by a process from the group consisting of: etching, die punching, and cutting.

33. The method of claim 27, wherein said electric heating element is a thin film deposition circuit.

34. The method of claim 33, wherein said thin film circuit is applied to said quartz substrates by a process from the group consisting of: sputtering, vapor deposition and ion implantation.

35. The method of claim 27, wherein said second quartz substrate is attached to said first quartz substrate by fusing.

36. The method of claim 27, wherein said second quartz substrate is attached to said first quartz substrate by bonding.

37. The method of claim 26, wherein said heating element is applied to said quartz substrate in a continuous process, and further comprising the step of cutting said substrate to a desired length.

* * * * *